US005338097A

United States Patent [19]

Tan

[11] Patent Number: 5,338,097

[45] Date of Patent: Aug. 16, 1994

[54] FURNITURE CONSTRUCTION

[76] Inventor: Marz Y. Tan, 2076 20 La. Apt. 2f, Brooklyn, N.Y. 11214

[21] Appl. No.: 79,285

[22] Filed: Jun. 21, 1993

[51] Int. Cl.[5] ..... A47C 1/12

[52] U.S. Cl. ..... 297/445; 297/441.41; 297/452.1; 297/452.64; 297/463

[58] Field of Search ..... 297/445, 452.64, 411.41, 297/452.1, 463

[56] References Cited

U.S. PATENT DOCUMENTS

| | | | |
|---|---|---|---|
| 2,199,845 | 5/1940 | Wolf . | |
| 3,692,281 | 9/1972 | Clayton . | |
| 3,694,030 | 9/1972 | Grosfillex | 297/445 |
| 3,771,583 | 11/1973 | Bottemiller | 297/445 |
| 4,160,299 | 7/1979 | Hilbern | 297/463 |
| 4,188,983 | 2/1980 | Graham et al. | 297/445 |
| 4,989,916 | 2/1991 | Powell . | |
| 5,118,162 | 6/1992 | Saul | 297/463 |

*Primary Examiner*—John T. Kwon
*Attorney, Agent, or Firm*—Richard C. Litman

[57] ABSTRACT

A furniture construction wherein articles of furniture are formed from discarded tires. A support and pedestal are formed from portions of tire casings having little to no salvage value. In one embodiment, a chair is formed wherein the support comprises a backrest, an armrest, and a seat, and the pedestal is a main support structure for supporting or suspending the support. The backrest is formed from a sidewall of the tire casing and the armrest is formed from a tread portion of the tire casing. The seat is formed from woven strips of body plies. The main support structure comprises a base and two legs, each formed from the bead of a sidewall.

8 Claims, 4 Drawing Sheets

S

S

FURNITURE CONSTRUCTION

BACKGROUND OF TIE INVENTION

1. Field of the Invention

The present invention relates to furniture construction and, more particularly, to chairs and tables produced essentially from discarded or scrap motor vehicle tire casings.

2. Description of the Prior Art

When tires used on motor vehicles become worn, it is necessary that the same be replaced. Upon replacement, the worn tires are generally discarded. Disposal of worn tires has become a major problem, as is evidenced by the large stockpiles of worn tires in our nation's salvage or scrap yards. Tire manufacturers have little need for worn tires, as the tire casing is not one which is readily recyclable at an economic cost. A demand exists for ground rubber dust which can be buffed-off from whatever remains of the worn tread but this comprises only a small percentage of the overall weight of the tire. The bulk of the tire remaining is of little to no economic value and presents a substantial disposal problem. It would be environmentally and economically advantageous to provide a useful commercial outlet for worn motor vehicle tires. In fact, commercial outlets for worn tire casings have been devised.

It is known to fashion articles from worn tires. For example, U.S. Pat. No. 2,199,845, issued May 7, 1939 to Frank Wolf, discloses receptacles fabricated from discarded tires. Another use of discarded tires is disclosed in U.S. Pat. No. 3,692,281, issued Sep. 19, 1972 to George W. Clayton who discloses the use of discarded tires to produce a nestable traffic marker. Yet another use of scrap tires is disclosed in U.S. Pat. No. 4,989,916, issued Feb. 5, 1991 to James A. Powell. Powell discloses an upholstered article of furniture in the form of an ottoman which comprises a single scrap rubber tire, or a stack of scrap tires, mounted generally horizontally on a base. Upholstery covers the tire or tires and padding is arranged between the tire or tires and the upholstery.

None of the above inventions and patents, taken either singly or in combination, is seen to describe the instant invention as claimed.

SUMMARY OF THE INVENTION

The present invention is a furniture construction wherein articles of furniture are formed from worn pneumatic motor vehicle tire casings. A chair is formed including a support comprising a backrest, an armrest, and a seat, and a pedestal or main support structure for supporting or suspending the support. The backrest is formed from a sidewall of the tire casing by cutting the tire casing circumferentially along the tread and the armrest is formed from the tread portion. The seat is formed from woven strips of body plies. The woven strips are attached to the backrest. The main support structure comprises a base and two legs, each formed of the bead of a tire. The base is horizontally disposed and rests on a supporting surface. The legs are diagonally disposed so as to crisscross structure having an upper connected to the bottom of the seat and backrest and having a lower end connected to the base. Strips of body ply are wrapped about the two legs at the intersection of the same. Alternatively, a table is formed wherein the support is in the form of a top and the pedestal or main support structure supports or suspends the top. The top includes support ring and a surface. The support ring is formed from the bead of a sidewall. The surface of the table is formed from woven strips of body plies. The woven strips are pulled taut and attached about support ring so as to be firm. The main support structure comprises a base and three legs, each formed of a bead of a tire. The base is horizontally disposed and rests on a supporting surface. The legs are each vertically disposed and have opposite ends which intersect one another to form a vertically extending, substantially equilateral triangular structure. The upper end of the triangular structure is connected to the support ring and the lower end thereof is connected to the base. Strips of body ply are wrapped about the two legs at the intersections of the same, the intersections being located substantially at the three points of the triangular structure. The present invention provides inexpensive furniture is constructed from scrap bias tires which have a relatively low salvage value. The furniture may be manufactured and distributed near a source of scrap tires to provide a reduction in transportation costs. Accordingly, a commercial return is derived essentially from scrap tires which have substantially no appreciable value.

Accordingly, it is a principal object of the present invention to derive a commercial return from the only portion of defected or discarded pneumatic motor vehicle tires having no appreciable value, leaving the tread of the tire to be buffed-off to produce rubber dust, thus maximizing the utilization of discarded tires.

It is an object to produce furniture from tire casings, utilizing the portions of the tire which have substantially no salvage value and rendering the tread portion of the tire to be reclaimed for its rubber content.

It is another object to produce furniture fabricated from scrap tires to reduce the habitat of mosquitos and vermin and to improve the environment by saving trees by providing an alternative to wooden furniture.

Still another to provide a method of constructing articles of furniture from tires.

It is an object of the invention to provide improved elements and arrangements thereof in an apparatus for the purposes described which is dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
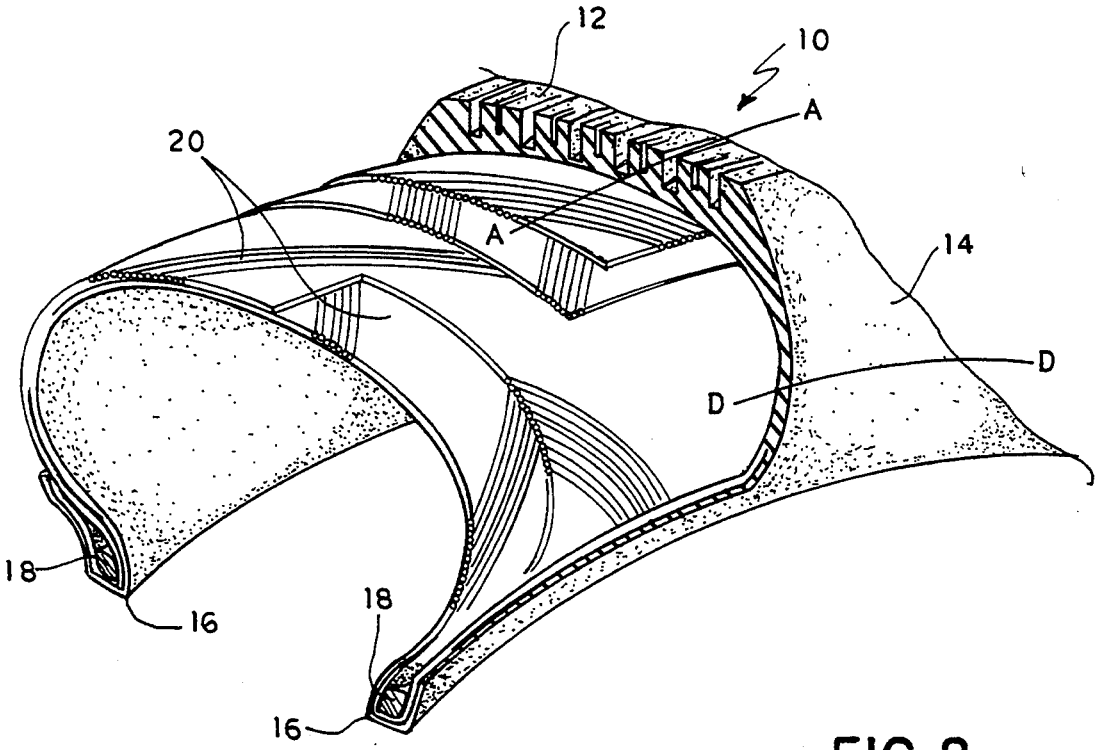
FIG. 1 is a partially cutaway, partially perspective view of a typical tire casing.
Figure 2:
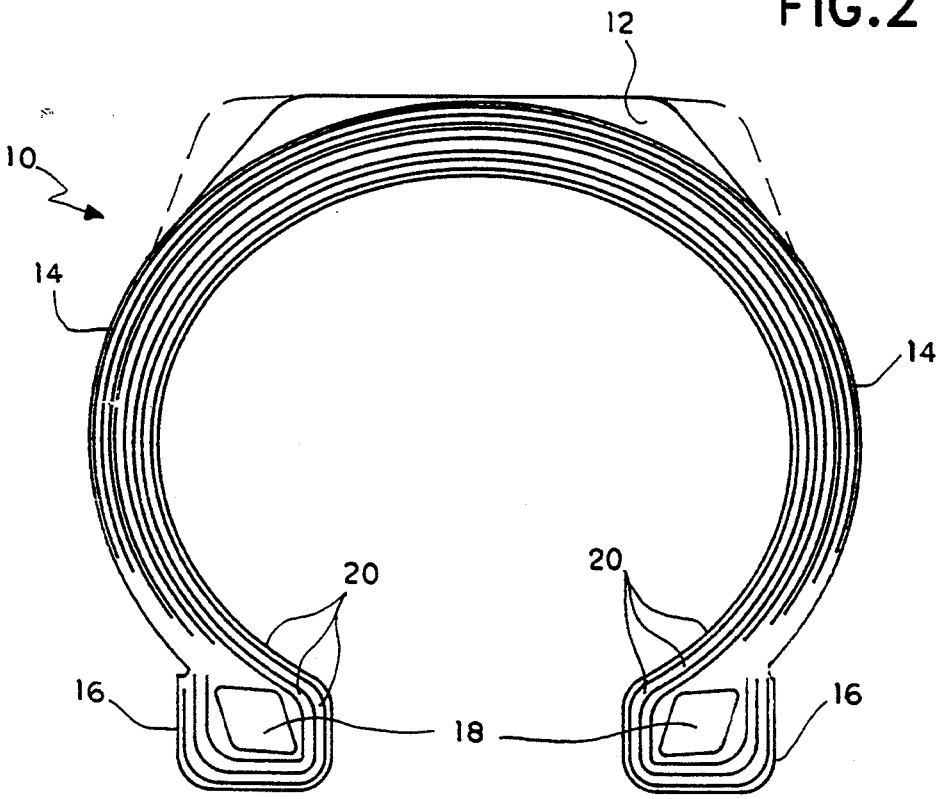
FIG. 2 is a cross sectional view of the typical tire casing shown in FIG. 1.

FIGS. 1 and 2 show a typical construction of a pneumatic motor vehicle bias tire casing 10 wherein a tread 12 extends laterally the width of the tire casing 10 and circumferentially about a periphery of the tire casing 10. Opposite sides of the tread 12 are formed integrally with oppositely disposed sidewalls 14. Each sidewall 14 is in the shape of an annulus terminating in a bead 16 adjacent the central opening of the annulus. Located centrally within each bead 16 are steel wires 18. Disposed interiorly of the tread 12 and sidewalls 14, and essentially forming about the steel wires 18 of the beads 16, are a plurality of inner body plies 20. Each body ply 20 is comprised of a rubber coated fabric cord layer. Parallel layers of rubber coated fabric cords form the plurality of plies 20.

Figure 3:
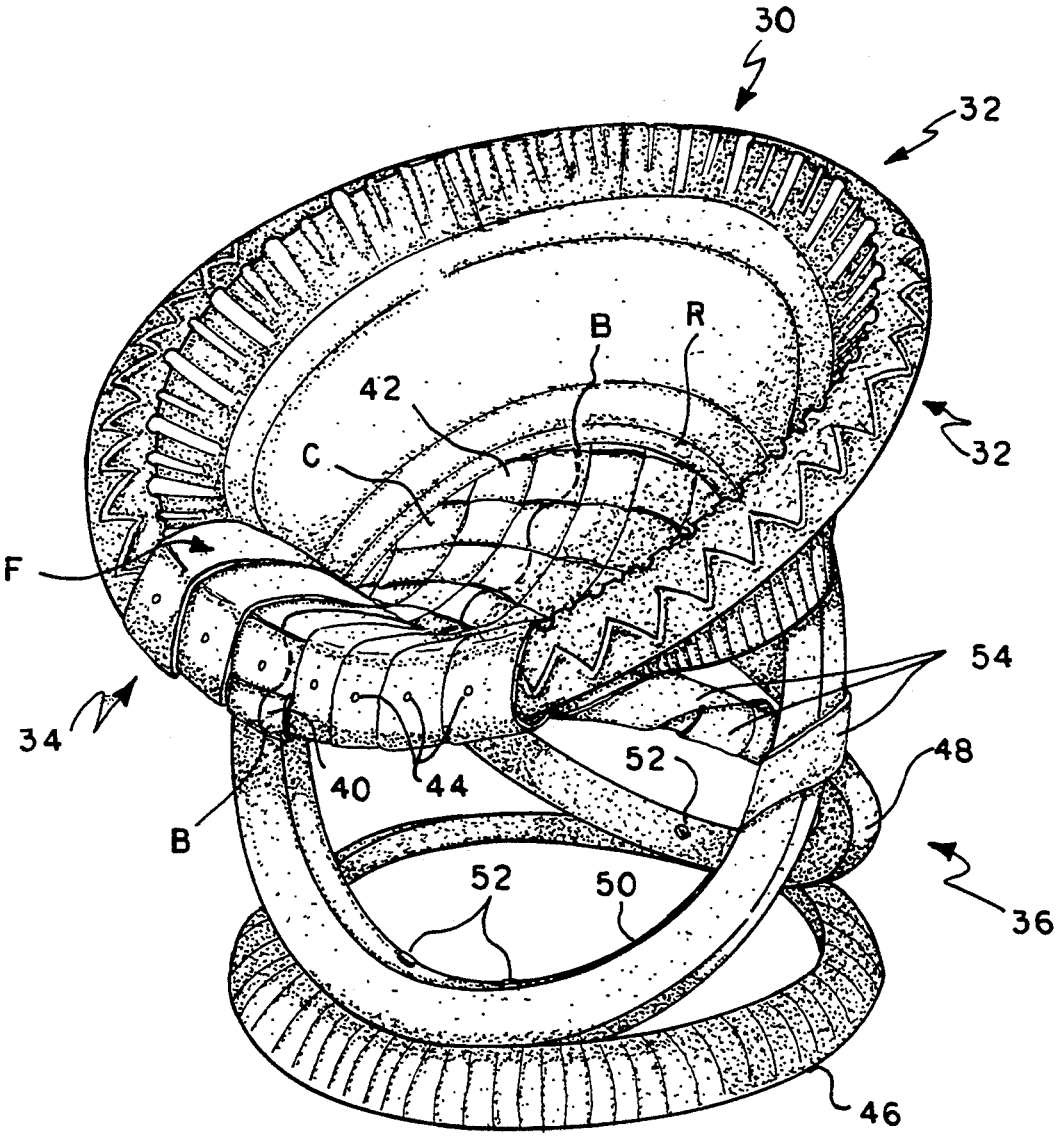
FIG. 3 is a front perspective view of a chair according to the present invention.
Figure 4:
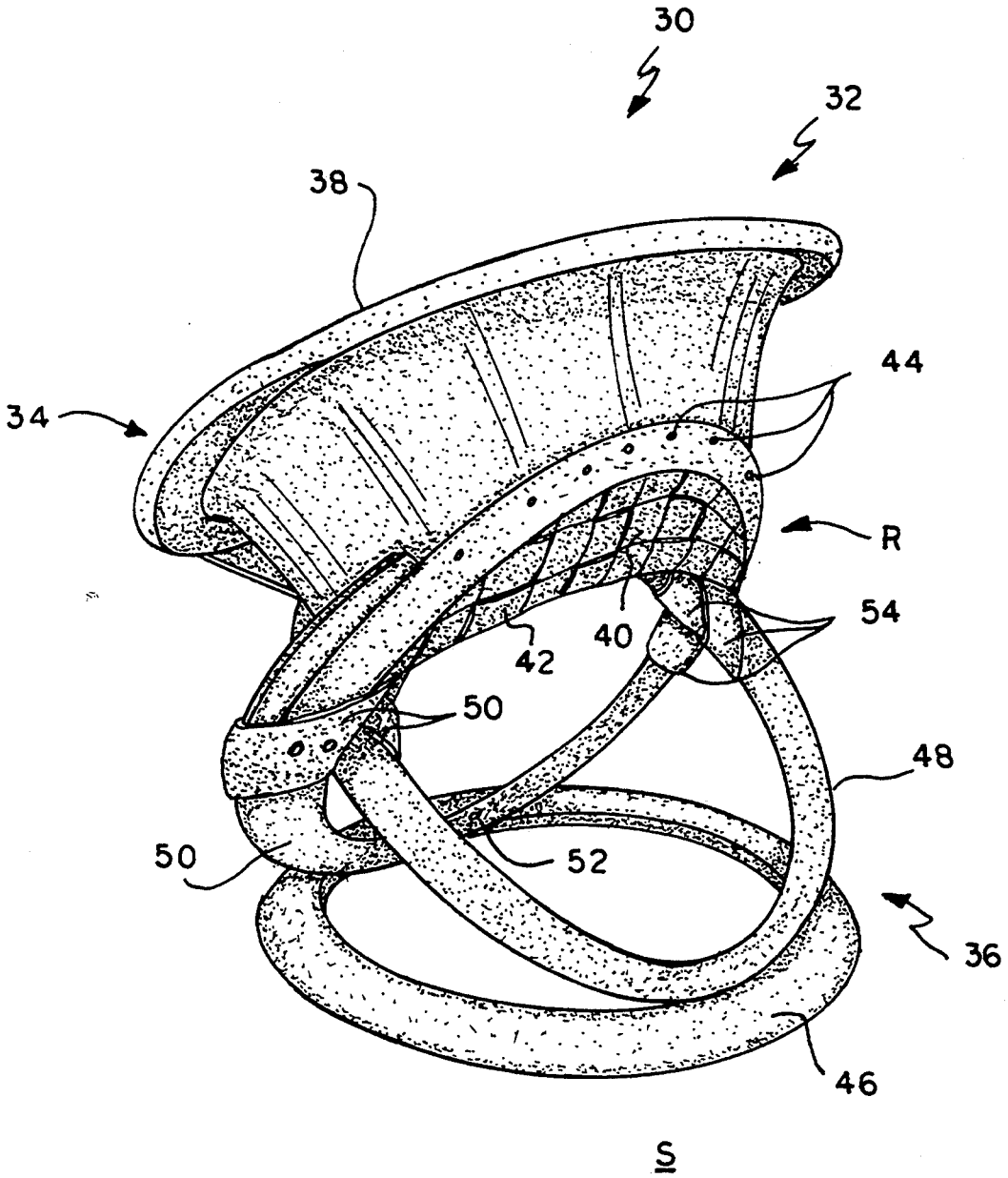
FIG. 4 is a rear perspective view of the chair shown in FIG. 3.
Figure 5:
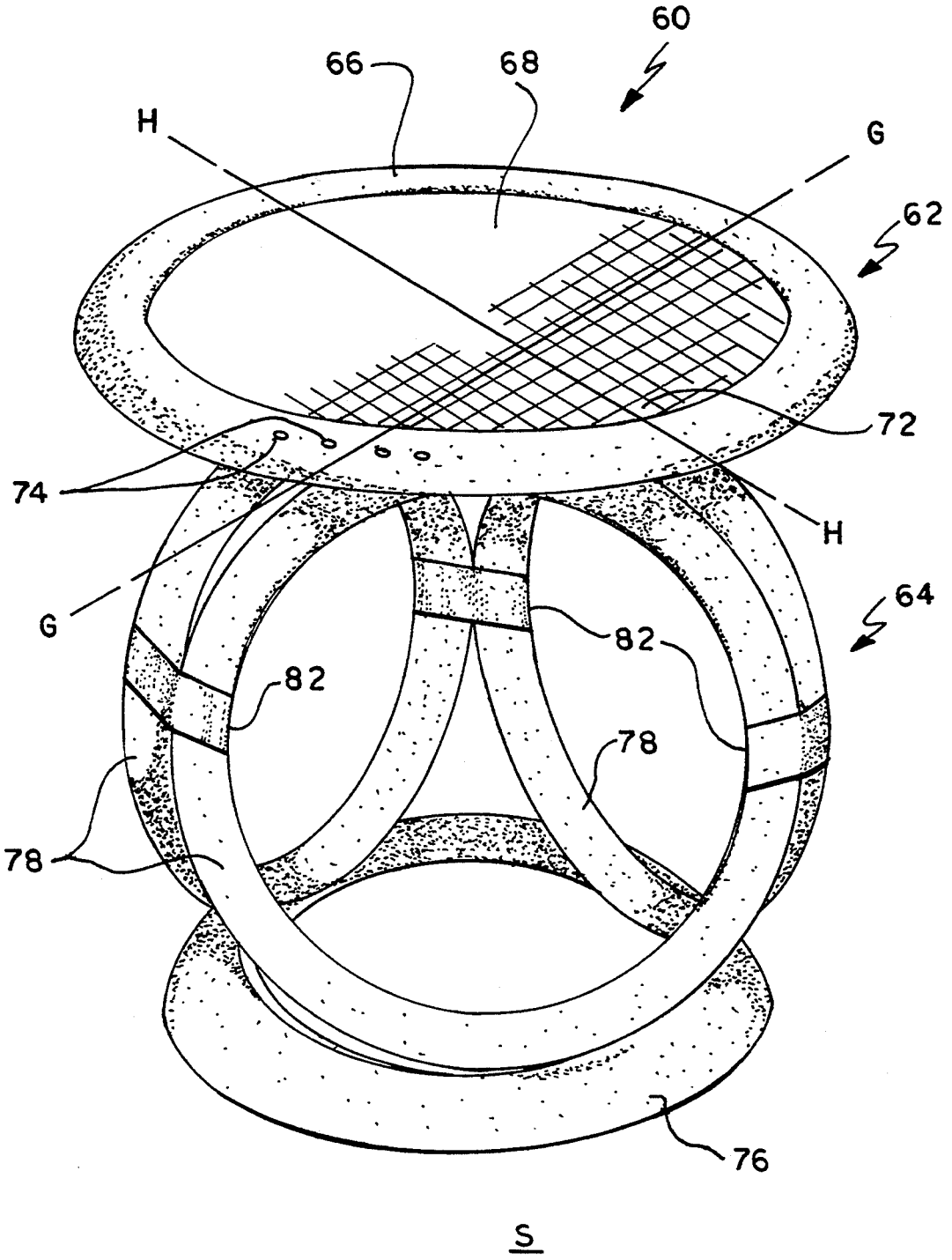
FIG. 5 is a perspective view of a table according to the present invention.

The present invention is a furniture construction wherein articles of furniture, such as the chair 30 and table 60 shown in FIGS. 3 through 5, are formed from worn pneumatic motor vehicle tire casings 10. The portions of the tire casings 10 used are most generally the portions which have substantially no salvage value, such as a nominal amount of tread 12, the sidewalls 14, the beads 16, and the body plies 20. Portions of the tread 12 may remain unused to be reclaimed for the rubber content thereof, thus maximizing the utilization of discarded tire casing 10. Preferably 10.00-20, 12 or 14 bias ply truck or trailer tires are used to produce articles of furniture intended to support adults. However, bias tires used on passenger automobiles may be suitable for articles of furniture configured to accommodate children.

FIGS. 3 and 4 show a chair 30 according to the present invention. The chair 30 includes a support comprising a backrest 32 and a seat 34, an armrest 38 and a pedestal or main support structure 36 for supporting or suspending the seat 34. The backrest 32 is formed from a sidewall 14 of the tire casing 10 by cutting the tire casing 10 circumferentially along the tread 12, such as along the line A—A shown in FIG. 1, at a distance approximately two and one-half inches from the border of the sidewall 14 and the tread 12. The bead 16 of the tire casing 10 forms the portion of the backrest 32 disposed adjacent the seat 34. The two and one-half inches of tread 12 about the outer periphery of the sidewall 14 form an armrest 38. If an armrest 38 of a greater length is preferred, the tire casing 10 may be cut along the tread 12 at a distance greater than two and one half inches and vice versa.

The seat 34 is formed from woven strips 40, 42 of body plies 20. This is accomplished by first separating the parallel layers of rubber coated fabric cords into individual plies 20. Each individual ply 20 is then cut longitudinally into strips 40, 42 having uniform widths of two inches. A first set of strips 40 are disposed parallel relative to one another along the line B—B and are woven together at right angles to a second set of strips 42 which are also disposed parallel relative to one another along the lines C—C. The woven strips 40, 42 are attached along the lower forward two and one-half inch margin of tread 12 and about the upper and side portions of the bead 16. The tread 12 and the bead 16 each are configured to provide a strong structural support for the attachment thereto of the woven strips 40 forming the seat 34. This configuration further provides a seat 34 having a firm support area F and a resilient support area R. The seat 34 is attached to the backrest 32 through the use of fasteners 44 such as nails, matingly engageable threaded fasteners, or rivets. The fasteners 44 are preferably of a material suitable, such as stainless steel, to withstand the effects of inclement environmental conditions.

The pedestal or main support structure 36 comprises a base 46, a first leg 48, and a second leg 50, each formed of the bead 16 of a tire 14. Each bead 16 is cut, such as long line D—D, about three inches into the sidewall 14 to provide a base 46 and legs 48, 50, each having a three inch width. The base 46 is horizontally disposed and rests on a supporting surface S. The first and second legs 48, 50 are each diagonally disposed so as to crisscross and intersect one another transversely. One end of the first leg 48 is connected to the margin of tread 12 along the forward most lower end of the sidewall 14 adjacent the forward end of the seat 34. The opposite end of the first leg 48 is connected to the rear end of the base 46. Similarly, one end of the second leg 50 is connected to the bead 16 adjacent the rear end of the seat 34 and the opposite end thereof is connected to the front end of the base 46. These connections are completed with fasteners 52 such as the fasteners 44 described above. Strips 54 of body ply 20 are wrapped about the two legs 48, 50 at the intersection of the same, the intersection being located substantially at a midpoint between the opposite ends of the same. The configuration of the legs 48, 50 in combination with the base 46 and the respective connections of the same form a structure capable of supporting adults as well as children (neither of which are shown). The resilient properties of the tire casing 10 provide a comfortable resilient chair 30.

FIG. 5 shows a table 60 according to the present invention. The table 60 includes a support in the form of a top 62 and a pedestal or main support structure 64 for supporting the top 62. The top 62 includes a peripheral support ring 66 and a surface 68. The support ring 66 is formed from the bead 16 of a sidewall 14 by cutting along the sidewall 14, such as along the line D—D shown in FIG. 1, to provide a support ring 66 having a four inch width.

Similar to that of the seat 34 of the chair 30, the surface 68 of the table 60 is formed from woven strips 70, 72 of body plies 20. Again, the strips 70, 72 are cut from individual plies 20. The individual plies 20 are cut longitudinally at uniformed widths of one to two inches to produce strips 70, 72 for the surface 68 of the table 60. A first set of strips 70 are disposed parallel relative to one another along the line G—G and are woven together at right angles to a second set of strips 72 which are also disposed parallel relative to one another along the lines H—H. The woven strips 70, 72 are pulled taut and attached about support ring 66 so as to be firm. The woven strips 70, 72 forming the surface 68 of the table 60 are attached to the ring 66 through the use of fasteners 74, such as the fasteners 44 mentioned above.

The pedestal or main support structure 64 comprises a base 76 and three legs 78, each formed of the bead 16 of a tire 14. Each bead 16 is cut, such as along the line D—D in FIG. 1, about three inches into the sidewall 14 to provide a base 76 and legs 78, each having a three inch width. The base 76 is horizontally disposed and rests on a supporting surface S. The legs 78 are each vertically disposed and have opposite ends which intersect one another to form a vertically extending, substantially equilateral triangular structure. The upper end of each of the three legs 78 is connected to the bead 16 forming the ring 66. The lower end of each of the three legs 78 is connected to the bead 16 forming the base 76. These connections are completed with fasteners 80 such as the fasteners 44 described above. Strips 82 of body ply 20 are wrapped about the two legs 78 at the intersections of the same, the intersection being located substantially at the three points of the triangular structure formed by the legs 78. This configuration provides a very rigid, yet slightly resilient table 60.

It is to be understood that the present invention is not limited to the embodiments described above, but encompasses any and all embodiments within the scope of the following claims.

I claim:

1. An article of furniture constructed from tire casings, each tire casing having a tread, sidewalls, beads, and inner plies, said article of furniture comprising:

a support including a backrest, an armrest and a seat; and a pedestal connected to said support to form a chair, said support and said pedestal being constructed from the tire casings.

2. The article of furniture according to claim 1, wherein said pedestal includes a base and a plurality of legs, said legs being connected to said seat and said base.

3. The article of furniture according to claim 2, wherein said base is horizontally disposed so as to rest on a supporting surface, and wherein said plurality of legs includes a first and a second leg being diagonally disposed relative to one another so as to crisscross and intersect one another transversely.

4. The article of furniture according to claim 4, wherein said legs are bound together at the intersection by strips.

5. The article of furniture according to claim 2, wherein said base is horizontally disposed so as to rest on a supporting surface, and wherein said plurality of legs includes three legs being connected together so as to form a vertically disposed, equilateral triangular structure.

6. A method of constructing an article of furniture from tires, said method comprising:

cutting tire casings into separate and distinct elements, forming a support from certain separate and distinct parts; and forming a pedestal from certain other separate and distinct parts.

7. A method according to claim 6, wherein said support forming step further includes:

forming a backrest from a sidewall of the tire casings;

forming an armrest from a tread of the tire casings; and forming a seat from inner plies of the tire casings; and wherein said pedestal forming step further includes:

forming a main support structure from beads of the tire casings.

8. A method according to claim 6, wherein said support forming step further includes:

forming a support ring from a bead of the tire casings; and forming a table surface from inner plies of the tire casings; and wherein said pedestal forming step further includes:

forming a main support structure from beads of the tire casings.

* * * * *